United States Patent [19]

Sirota

[11] Patent Number: 4,709,953

[45] Date of Patent: Dec. 1, 1987

[54] ROLL HANDLING APPARATUS

[75] Inventor: Gabriel J. Sirota, Gibsonia, Pa.

[73] Assignee: Amco Industries, Inc., Ford City, Pa.

[21] Appl. No.: 808,758

[22] Filed: Dec. 13, 1985

[51] Int. Cl.[4] ..... B66C 1/00

[52] U.S. Cl. ..... 294/106; 294/103.2

[58] Field of Search ..... 294/106, 103.2, 103.1, 294/67.31, 67.33, 104, 111, 112; 414/620, 621, 783, 911

[56] References Cited

U.S. PATENT DOCUMENTS

| | | | |
|---|---|---|---|
| 1,969,873 | 8/1934 | Bradford | 294/106 |
| 3,273,931 | 9/1966 | Caldwell et al. | 294/106 |
| 4,368,913 | 1/1983 | Brockmann et al. | 294/106 |

FOREIGN PATENT DOCUMENTS

| | | | |
|---|---|---|---|
| 757138 | 2/1979 | U.S.S.R. | 294/106 |

*Primary Examiner*—James B. Marbert

*Attorney, Agent, or Firm*—Robert D. Yeager; George D. Dickos

[57] ABSTRACT

Apparatus for safely lifting a roll of material having a horizontal eye is disclosed. The apparatus consists of a tong having horizontally relatively movable lifting legs which each include lifting decks to engage the roll's eye. Sliding members are provided to yieldingly address the roll ends and to move horizontally and vertically during closing of the lifting leg under the control of a dampening means. Additionally, the sliding members are maintained stationary with the roll during movement of the tong to engage the eye with the lifting decks to avoid scraping of the roll ends. A spring means is provided to return the sliding member to its rest position following the release of the displaced rolls.

23 Claims, 7 Drawing Figures

ROLL HANDLING APPARATUS

BACKGROUND OF THE INVENTION

1. Field of the Invention

The present invention relates to apparatus for material handling and, in particular, to apparatus for grasping for lifting a roll of material having its eye disposed in a horizontal orientation.

2. Description of the Prior Art

In a myriad of industrial settings, a troublesome material handling problem relates to the manipulation of a roll of a given material. Frequently, such rolls comprise a metallic material such as steel or aluminum, but they may also consist of other materials including plastics, textiles or paper products. Such rolls of material are formed with an eye which may be oriented vertically or horizontally.

While the prior art includes means for lifting rolls having a vertical eye, such means typically simply grasp the outer diameter of the roll prior to lifting. As is well known in the industries involved, and especially those involving rolls of metallic materials, such grasping virtually always disfigures the outer wraps of material as well as deforming the cylindrical shape of the material. Obviously, in relation to the former condition, the disfigured material must be scrapped. However, regarding the deformation of the roll, the apparatus for working on the rolled material usually operates at high speeds, which operation will be readily seen to be especially dangerous if the roll is out of round.

As such, it has proven expedient to handle rolls of material, which material will, by means of example only, be herein referred to as a web of metallic material, with the eye oriented horizontally. Typical prior art apparatus for handling a horizontal roll includes a tong suspended from a remotely operated overhead crane. The tong usually includes a central body portion including a gear system for horizontally displacing a pair of vertical lifting legs. Such legs are provided with lifting portions which are caused to surround the roll and enter the inside diameter of the roll when the legs are brought together. The lifting surface is then raised to engage the roll's eye prior to roll lifting.

While such tongs avoid some of the drawbacks of the vertical eye lifting apparatus, prior art tongs are beset with a host of difficulties of their own. Frequently, such tongs are employed in an environment which includes a multiplicity of rolls in close proximity to one another. When the crane operator brings the tong's legs adjacent the roll to be lifted, due to the usually considerable distance between the operator and the tong, the tong legs are often caused to strike the roll to be lifted as well as adjacent rolls thereby damaging various portions thereof and especially the edges. Further, when the lifting surfaces of the tong legs are disposed at an elevation within the inner diameter of the roll and the legs are brought together or closed, the remote operator has no clear way of ascertaining when the inner surfaces of the legs engage the ends of the roll. As such, the operator usually runs the legs inward until they strike the roll ends thereby damaging the roll ends and the lifting legs as well as severely jarring the tong's gear box.

Next, during a typical lift, the tong is raised until the lifting surface engages the roll's inner diameter. It will be readily appreciated that during the lifting of the tong relative to the roll while the inner surfaces of the lifting legs engage the roll ends, the lifting legs are caused to scrape against, and, hence, severely damage such roll ends. Obviously, all of the above-discussed situations result in the scrapping of an extreme amount of costly semi-finished product costing industry untold dollars annually.

The prior art has attempted to deal with the problem of scraping the lifting legs against the roll ends by providing a sliding device on the inner surface of the lifting legs. In such a device, the legs engage the roll and the sliding device slides with the roll relative to the lifting leg. A counterweight and pulley system may be provided to return the sliding member to its original position following the lift.

It is clear that such prior art apparatus is, however, replete with most of the problems of the other prior art apparatuses. For example, no means is known for protecting the roll and adjacent rolls from damage during tong positioning. Also, and very importantly, there is no known means for protecting the roll or the tong from harm during the closing of the legs about the roll.

The subject invention is directed toward an improved apparatus for grasping for lifting a roll of material which overcomes, among others, the above-discussed problems and which is effective to grasp a horizontal roll without damaging the roll in question, adjoining rolls or the apparatus itself.

SUMMARY OF THE INVENTION

In accordance with the present invention, there is provided apparatus for grasping for lifting a horizontal roll or coil of material. The apparatus provided includes a central body portion which may be lifted by an overhead lifting apparatus, such as a crane, and which movably supports dual lifting legs for horizontal and vertical movement. Gear means is provided in the body portion for moving the legs relative to one another.

Each lifting leg includes a frame portion having sides and outer members. A radiused, horizontal lifting deck is affixed to the inner portion of each leg for engaging for lifting a horizontal roll. Further, inner and outer resilient rollers are rotatably supported on the frame portion for protecting the roll to be lifted as well as adjacent rolls during tong positioning. The lifting legs also include a guide means for addressing the ends of the roll. The guide means includes a vertical face plate having an outer wear surface and vertical side members extending from its rear surface. Such side members each include upper and lower vertical slots. Dual upper and lower arms are pivotally attached amid their length to the side portions of the frame member. Each of the upper arms is provided with a pin for slidingly engaging one of the upper vertical slots while each of the lower arms is provided with a pin for slidingly engaging one of the lower vertical slots. Further, a vertical link is pivotally attached to the other ends of the upper and lower arms. A shock absorbing means is pivotally connected to the lower end of the vertical link while spring means are connected to the upper portions of each of the side members of the face plate.

In operation, the lifting legs are opened and moved into position with the lifting decks being disposed at an elevation intermediate the roll's inside diameter. Due to the provision of the inner and outer resilient rollers, the roll to be lifted as well as adjacent coils are protected from damaging impact by the lifting legs themselves. When the lifting legs are brought toward one another the guide means address the ends of the roll. As the legs are closed slightly further, the guide means are displaced horizontally and vertically if, during a given operation the wear surfaces slide on the roll ends, or only horizontally, if the wear surfaces do not slide on the roll ends. In either event, there is no harm to the roll during the closing of the lifting legs. The tong is then lifted until the lifting deck engages the inner diameter of the roll. During this step, however, due to the engagement of the guide means with the roll ends, the face plate remains stationary with the roll during tong lifting due to the sliding of the pins within the vertical slots. The shock absorbing means provides dampening and force absorbing actions during leg closing and lifting deck positioning. The roll may then be lifted in customary fashion.

When the roll is moved to its intended location, the tong lowers it to the ground, the tong is lowered an incremental amount to allow the lifting decks to release the eye of the roll and the legs are reopened, again with the wear surfaces sliding easily on the roll ends. The spring means then raises the guide means to its rest position for engagement with another roll.

Accordingly, the present apparatus provides solutions to the aforementioned problems in the handling of rolls of material. As this invention provides an effective means for lifting a horizontal roll without damaging the roll, adjacent rolls or the tong itself, the problems caused by roll damaging lifting means are avoided. In addition, due to the provision of features for safeguarding rolls, the tong itself is protected thereby reducing downtime for tong replacement and/or maintenance.

These and other details, objects and advantages of the invention will become apparent as the following description of the present preferred embodiment thereof proceeds.

BRIEF DESCRIPTION OF THE DRAWINGS

In the accompanying drawings I have shown a present preferred embodiment of the invention wherein.

DETAILED DESCRIPTION OF THE PREFERRED EMBODIMENT

Figures 1, 2, 3, 4:
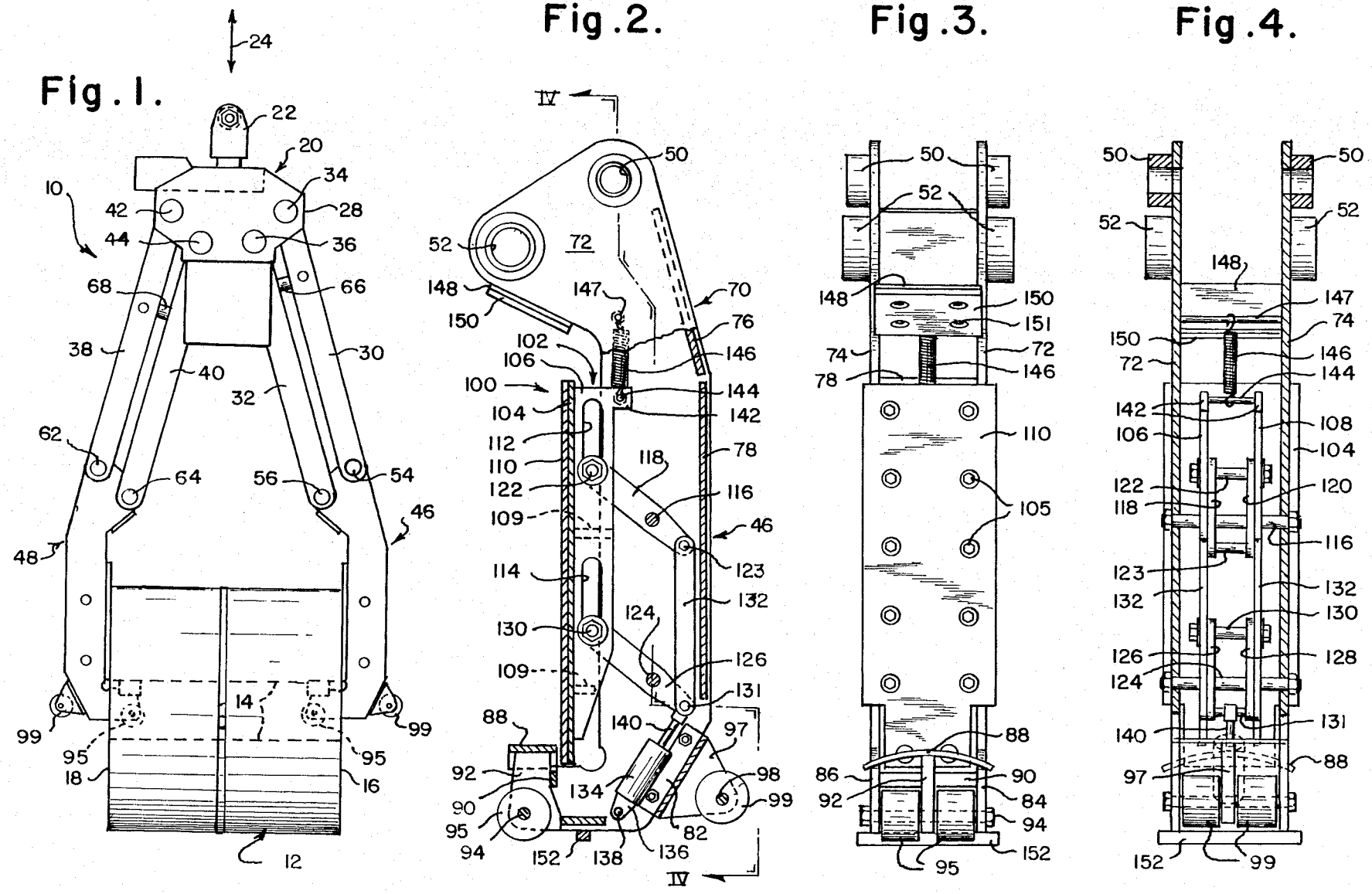
FIG. 1 is a side elevation view of a lifting tong provided with lifting legs according to the present invention.
FIG. 2 is a side elevation sectional view of a lifting leg of the present apparatus.
FIG. 3 is a front elevation view of the lifting leg provided herein.
FIG. 4 is a rear elevation sectional view of the present lifting leg taken along the sectional lines in FIG. 2.
Figure 5:
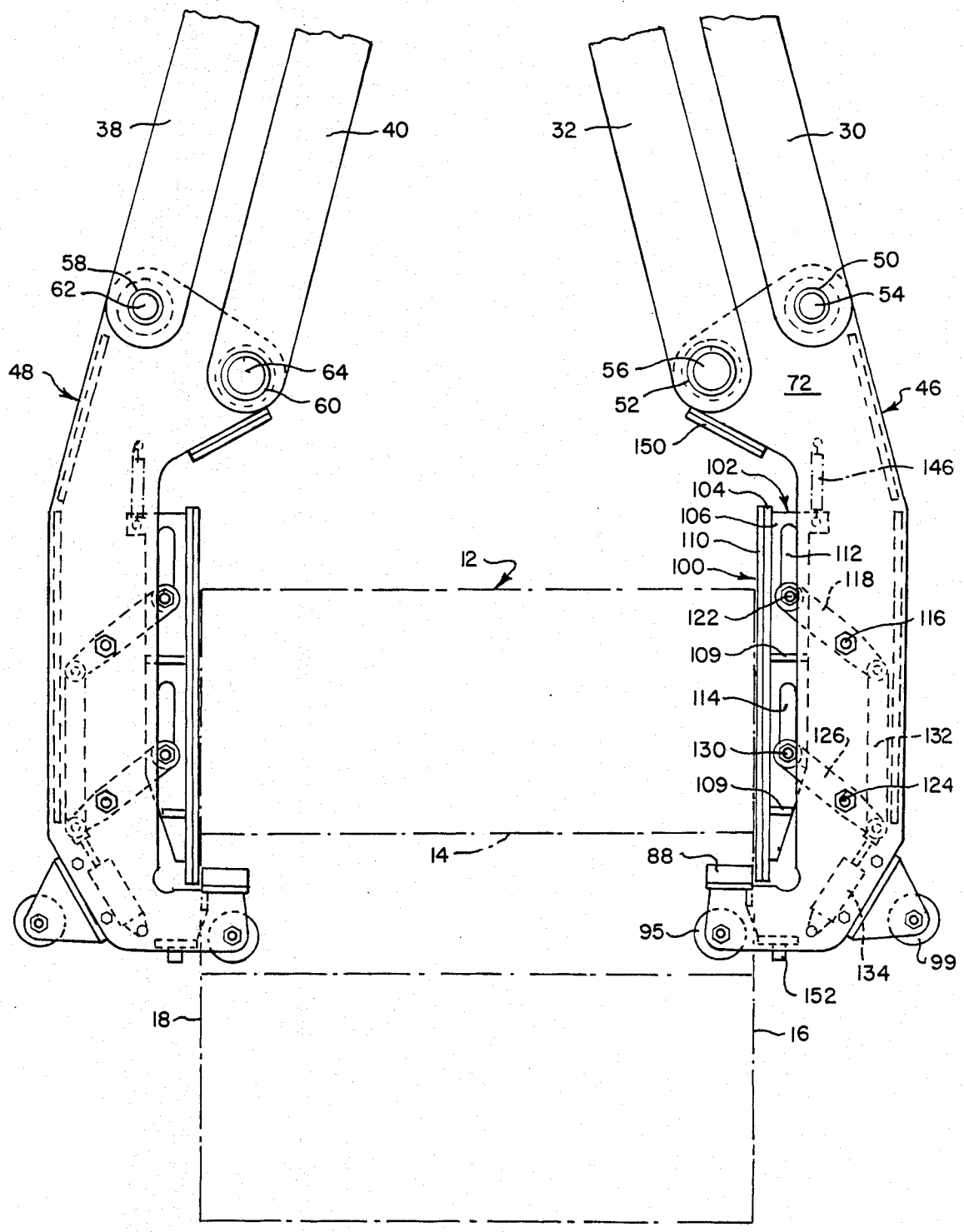
FIG. 5 is a side elevation view of a pair of lifting legs in one position.
Figure 6:
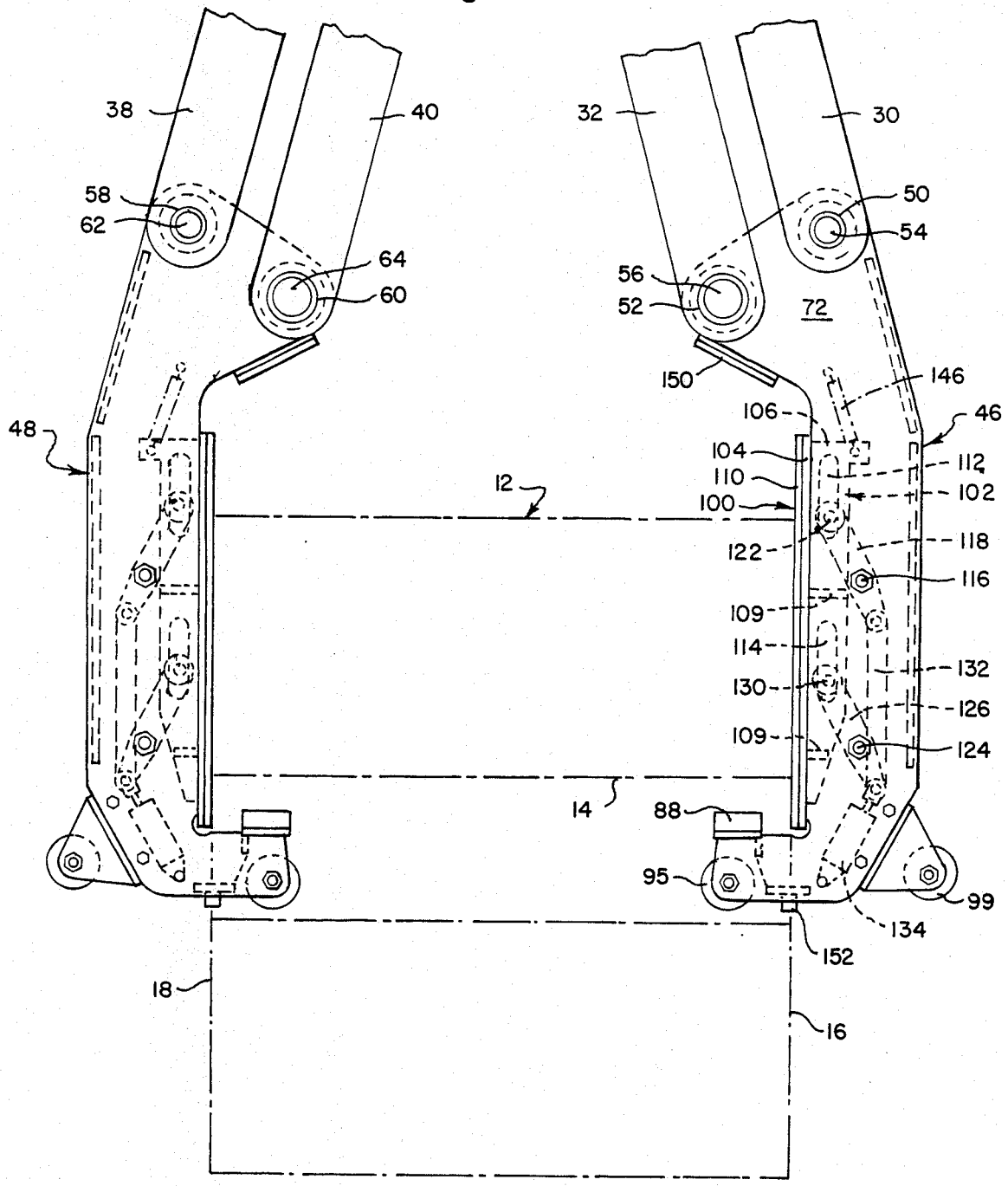
FIG. 6 is a side elevation view of a pair of lifting legs in another position; and, FIG. 7 is a side elevation view of a pair of lifting legs in yet another position.
Figure 7:
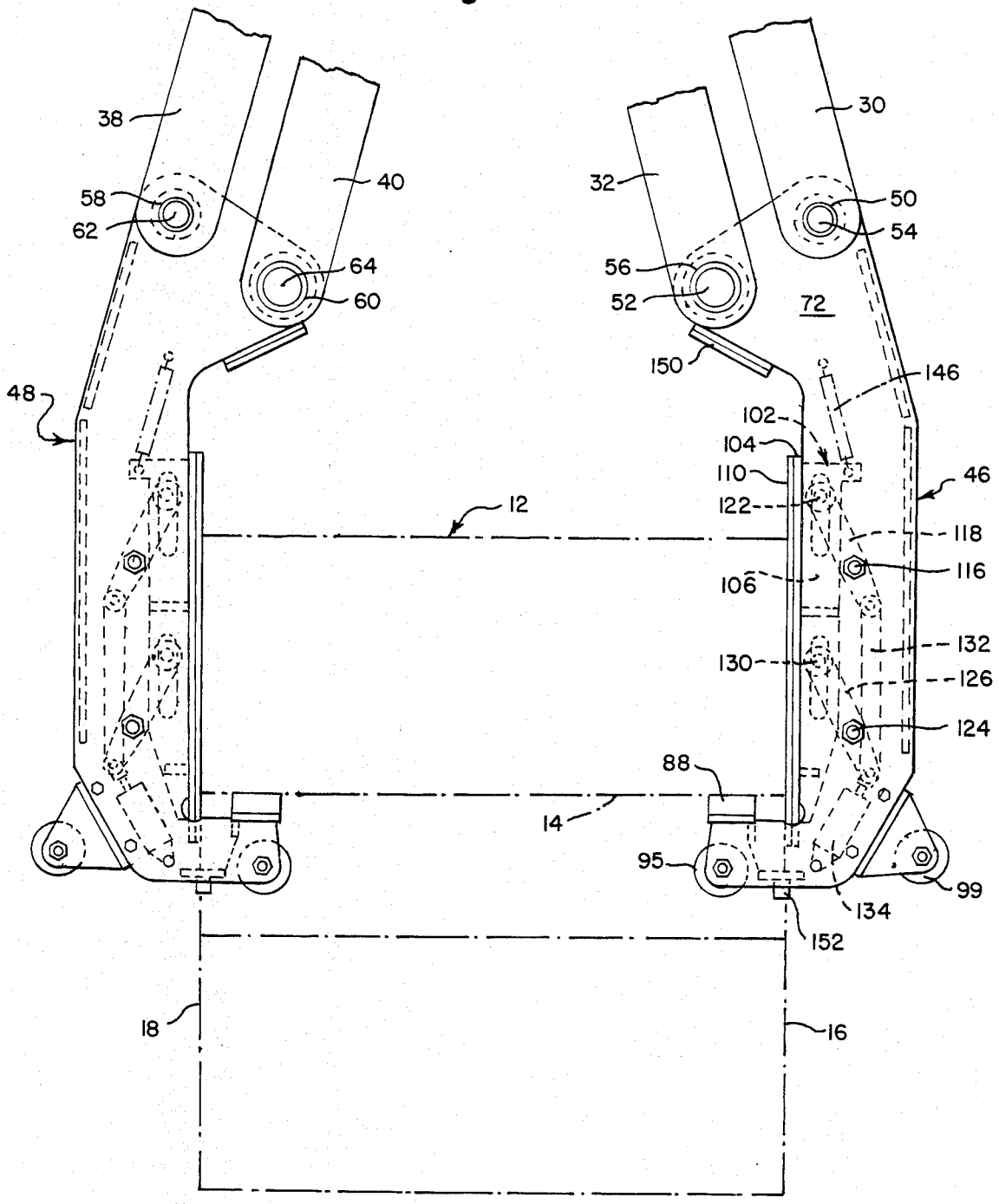

Referring now to the drawings wherein the showings are for purposes of illustrating the present preferred embodiment of the invention only and not for purposes of limiting the same, the figures show a lifting apparatus 10 for grasping a roll of material 12.

More particularly and with reference to FIG. 1, there is shown a roll 12 disposed on its side and having its eye or inner diameter 14 oriented in a horizontal direction. Roll 12 may consist of any type of material in a rolled form such as a coiled strip of a metallic substance like steel or aluminum or any other material, for example, plastics, textiles, paper products, etc. For the purposes of the present DETAILED DESCRIPTION OF THE PREFERRED EMBODIMENT, without limiting the invention, reference will be made to a roll 12 of strip metallic material. Roll 12 has first and second ends 16 and 18, respectively.

Lifting apparatus 10, otherwise known as a lifting tong, is capable of grasping and lifting a roll 12 having a horizontal eye. As such, tong 10 includes a central body portion, generally 20, which is provided with a means, such as a horizontally pivotable bale 22 which may be operatively engaged by an external lifting means, indicated generally by arrow 24, such as an overhead crane, which employs a means for engaging bale 22. Lifting means 24, therefore, is capable of lifting tong 10 and roll 12 and displacing it to another location under the control of an operator who is typically stationed a considerable distance from tong 10.

The body portion 20 of tong 10 includes a housing 28 supported by bale 22. Housing 28 has pivotally connected thereto a right upper support arm 30 and a right lower support arm 32 by means of pins 34 and 36, respectively. Similarly, left upper support arm 38 and left lower support arm 40 are pivotally attached to housing 28 by means of pins 42 and 44, respectively. The means for grasping roll 12 by means of tong 10 include right lifting leg, generally 46, and left lifting leg, generally 48, which are respectively supported by right support arms 30 and 32 and left support arms 38 and 40.

In particular, right lifting leg 46 is provided at its uppermost end with an upper eye 50 and a lower eye 52. Right upper eye 50 is in pivotal engagement with an upper pin 54 supported by the lower end of right upper arm 30 while right lower eye 52 is in pivotal engagement with a lower pin 56 supported by the lower end of right lower arm 32. Correspondingly, the upper end of left lifting leg 48 is provided with a left upper eye 58 and a left lower eye 60. Left upper eye 58 is in pivotal engagement with an upper pin 62 supported by the lower end of left upper arm 38 while left lower eye 60 is in pivotal engagement with a lower pin 64 supported by the lower end of left lower arm 40. Accordingly, right lifting leg 46 is supported by right support arms 30 and 32 while left lifting leg 48 is supported by left support arms 38 and 40. Since the distance between right upper pins 34 and 36 is equal to the distance between right lower pins 54 and 56, the right arms 30 and 32 act as links in a four-bar linkage to assure that right lifting leg 46 is always vertical. Also, since the distance between left upper pins 42 and 44 is the same as the distance between left lower pins 62 and 64, the left support arms 38 and 40 act as links in a four-bar linkage to assure that left lifting leg 48 is always maintained in a vertical orientation.

The lifting legs 46 and 48, respectively, are moved horizontally relative to one another by means of an operator controlled gear box (not shown) known to those skilled in the art which cooperates with a right linkage 66 connected to right upper arm 30 and a left linkage 68 connected to left upper arm 38. As such, when the gear box moves linkages 66 and 68, respectively, in a coordinated manner, right upper arm 30 and left upper arm 38 are also moved vertically and horizontally together and apart in unison. Due to the mechanical relationship of the parts described above, such movements of right upper arm 30 and left upper arm 38 move right lifting leg 46 and left lifting leg 48 in a coordinated fashion either toward or away from one another. It is to be understood that while the above means for supporting lifting legs 46 and 48, respectively, sets forth a preferred mechanism therefor, alternative apparatus may be provided for the support and displacement of lifting legs 46 and 48. By means of example only, tong housing 20 could alternatively include a rack and pinion gear system for supporting lifting legs 46 and 48 and for relatively moving them in a horizontal plane.

In view of the fact that left lifting leg 48 is symmetrical to or a mirror image of right lifting leg 46, only right lifting leg 46 will be described in detail herein. Right lifting leg 46 includes a frame, generally indicated as 70, which includes front and rear side members, 72 and 74, respectively. Frame 70 also includes an upper lateral element 76, middle lateral element 78 and lower lateral element 80 joining front side member 72 and rear side member 74. A lower plate 82 is also provided to add further rigidity to frame 70. It will be readily appreciated that right upper and lower eyes 50 and 52, respectively, actually comprise bushings that pass between corresponding apertures in front side member 72 and rear side member 74.

The front and rear side members 72 and 74, respectively, of frame 70 each include an inwardly extending portion 84 and 86, respectively. Passing between portions 84 and 86 is a radiused lifting deck 88. Lifting deck 88 is radiused to a radius corresponding to the anticipated inside diameter of rolls 12 to be lifted and provides the means for applying an upward lifting force to rolls 12. A stiffening bar 90 may be also provided between front and rear inner portions 84 and 86, respectively. A vertical plate 92 is provided to be affixed to stiffening bar 90 and front and rear inner portions 84 and 86, respectively. In addition, an axle 94 passes through front inner portion 84, vertical plate 92 and rear inner portion 86 which rotatably supports dual front rollers 95. Front rollers 95 preferably are formed from a resilient material in order to protect the roll 12 to be lifted during preliminary positioning and final removal of tong 10 from the roll 12.

The rear plate 82 on frame 70 spans front and rear side members 72 and 74, respectively, and supports dual rear extensions 97. An axle 98 passes between rear extensions 97 for rotatably supporting rear rollers 99 for protecting adjacent rolls during the grasping of a particular roll 12.

In order to protect roll ends 16 and 18 respectively, during the positioning of lifting legs 46 and 48, respectively, and the engagement of lifting deck 88 with eye 14, there is provided a guide means, generally designated as 100. Guide means 100 includes a slide member 102 having a face plate 104 and front and rear outwardly extending side elements 106 and 108, respectively. Lateral braces 109 extend between side elements 106 and 108, respectively. Face plate 104 is provided with a wearable surface element 110 secured to face plate 104 by means of countersunk bolts 105. Surface element 110 preferably comprises a material which will allow sliding along first and second roll ends 16 and 18, respectively, without causing significant harm thereto and which material will abrade during such sliding but will not become adhered to roll 12 which would interfere with the further processing of roll 12. Suitable materials for surface element 110 have been found to be nylon or micarta.

Front and rear side elements 106 and 108, respectively, are each provided with upper and lower slots 112 and 114, respectively. Additionally, a first pin 116 is mounted intermediate front and rear side members 72 and 74, respectively, to pivotally support, amid their length, dual upper pivotal links 118 and 120, respectively. An upper rod 122 is provided to pass intermediate the upper ends of upper pivotal links 118 and 120 and is configured to slidingly engage upper slots 112. An upper tie rod 123 joins the other ends of links 118 and 120. A second pin 124 is also mounted intermediate front and rear side members 72 and 74, respectively, to pivotally support, amid their length, dual lower pivotal links 126 and 128, respectively. A lower rod 130 is provided to pass intermediate the upper ends of lower pivotal links 126 and 128, respectively, and is configured to slidingly engage lower slots 114. Further, a lower tie rod 131 joins the lower ends of lower links 126 and 128. A pair of vertical links 132 are pivotally attached intermediate upper tie rod 123 and lower tie rod 131 to tie upper links 118 and 120, respectively, to lower links 126 and 128, respectively. A dampening means such as a shock absorber 134 having a loop 136 attached to its closed end is pivotally attached to frame 70 by means of a pin 138 passing between front and rear side elements 72 and 74, respectively. The end of the piston rod 140 of shock absorber 134 is pivotally attached to lower tie rod 131. In addition, front element 106 and rear element 108 are each provided with outward facing appendages 142 which are joined by means of a pin 144. One end of a means for generating a force based on displacement, such as a spring 146, is connected to pin 144 while the other end is connected to a pin 147 which passes intermediate front and rear side members 72 and 74, respectively.

According to a preferred embodiment of the present invention, an upper protection plate 148 is secured to the portion of frame 70 opposite lifting deck 88. Protection plate 148 is preferably provided with a wearable covering surface 150 attached thereto by means of countersunk bolts 151 which secure it and plate 148 to frame 70. Covering surface 150 is preferably formed from a material similar to guide means wear surface 110. Further, a resting bar 152 is preferably provided across the lowermost portion of frame 70 to extend further than rollers 95 so as to allow tong 10 to be placed on the ground while resting on bars 152 to protect from damage to or foreign matter becoming embedded in wheels 95 and/or 99. As will be appreciated, the lifting apparatus 10 will be preferably constructed with most parts being formed from a high strength steel.

In the operation of tongs 10, when a particular roll 12 is to be lifted, the lifting legs 46 and 48 are opened until the distance between their inner rolls 95 exceeds the length of the roll 12 by a comfortable margin depending on the environment in which the tong 10 is to be employed. The tong 10 is lowered and positioned by the lifting means 24 until the lifting decks 88 are disposed at an elevation intermediate and in alignment with the eye 14 of roll 12. During such lowering and positioning, rear rollers 99 are able to ride on adjoining rolls to prevent damaging contact by the outer portion of frame 70 while inner wheels 95 may ride on the roll 12 to be lifted to avoid damaging contact by the front and rear inner portions 84 and 86, respectively, and/or by the lifting deck 88.

The right lifting leg 46 and left lifting leg 48 are then brought together so as to cause their lifting decks 88 to enter the eye 14 of roll 12. As is common practice, due to the distance an operator is usually disposed from tong 10, the operator cannot usually accurately control the closing of legs 46 and 48, respectively, to have their lifting decks 88 enter eye 14 without having the legs 46 and 48 themselves contact the first and second roll ends 16 and 18, respectively. However, according to the present invention the guide means 100 on legs 46 and 48, respectively, address and contact the roll ends 16 and 18, respectively, without damaging the same. We have found that the roll 12 contacting of the wear surface 110 of face plate 104 follows one of two patterns. More frequently, when face plate 104 contacts a roll end such as 16, it does not slide thereon due to surface imperfections formed in wear surface 110 during use, but allows a controlled amount of additional horizontal movement by the leg 46 relative to roll end 16 to be absorbed by the horizontally outward displacement of sliding member 102. Alternatively, we have found that sliding member 102 undergoes horizontal and vertical movement during closing of leg 46 if wear surface 110 slides along roll end 16. In either event, during such movements of sliding member 102 of face plate 104, upper rod 122 rides in upper slot 112 while lower rod 130 rides in lower slot 114 and the sliding member 102 is maintained vertical. Such movement of upper rod 122 causes the pivoting of upper links 118 and 120, respectively, while the movement of lower rod 130 causes the pivoting of lower links 126 and 128 which pivotings are tied together by means of vertical links 132. However, it will be appreciated that the above movements are dampened and controlled by means of shock absorber 134. As such, the contacting of sliding member 102 with roll end 16 is controlled and is not an impacting thereof. An additional benefit of the avoidance of harm to the roll 12 is the reduced impact loading on the lifting legs 46 and 48 due to the shock absorbers 134 which also reduce the damaging effects of impact loadings on the gear box.

Once the first roll end 16 and second roll end 18 are adjacent sliding member 102, the tong 10 is incrementally raised to cause the lifting decks 46 to engage the eye 14 of the roll 12. However, if the face plates 104 are in contact with the roll 12 the frame 70 will be displaced incrementally upward but the coil 12 and the face plate 104 will remain at rest. As such, upper and lower pins 122 and 130, respectively, ride vertically in upper and lower slots 112 and 114, respectively, while face plate 104 remains stationary. Clearly, this action avoids the scraping of the metallic surfaces of legs 46 and 48 against roll faces 14 and 16, respectively.

The roll 12 then may be lifted and displaced by lifting apparatus 24 and subsequently lowered to the ground. When it is desired to release a roll 12 from tong 10, the roll 12 is lowered to the ground and the tong 10 is additionally lowered a small amount to release lifting decks 88 from the eye 14. This movement allows some sliding of face plate 104 relative to frame 70. The legs 46 and 48 are then opened thereby releasing the roll 12. Due to the action of the spring 146, the face plate 104 is raised to its ready position with pins 122 and 130 adjacent the bottoms of slots 112 and 114, respectively.

It will be understood that various changes in the details, materials and arrangements of parts which have been herein described and illustrated in order to explain the nature of the invention, may be made by those skilled in the art within the principle and scope of the invention as expressed in the appended claims.

What is claimed is:

1. A lifting leg for a tong means for grasping a roll having a horizontal eye comprising:

a. a frame means;

b. guide means supported by said frame means for yieldingly contacting the end of said roll and or horizontal and vertical movement relative to said frame means from a rest position to a displaced position; and, c. a horizontal lifting deck affixed to said frame means for engaging said horizontal eye.

2. Apparatus of claim 1 further comprising means for controlling the horizontal and vertical movement of said guide means relative to said frame means.

3. Apparatus of claim 2 in which said guide means further comprises:

a. a slide member having a vertical face plate and parallel side plates, said side plates being provided with upper and lower vertical slots;

b. a pair of upper arms each pivotally mounted amid its length to said frame means and having means at one end thereof for engaging one of said upper vertical slots;

c. a pair of lower arms each pivotally mounted amid its length to said frame means and having means at one end thereof for engaging one of said lower vertical slots;

d. link means joining the other ends of said upper and said lower arms; and, e. dampening means pivotally mounted on said frame means and coupled to said link means.

4. Apparatus of claim 3 further comprising means mounted on said frame means for returning said guide means from its displaced position to its rest position.

5. Apparatus of claim 4 further comprising first roller means mounted on said frame means in proximity to and below said lifting deck.

6. Apparatus of claim 5 further comprising second roller means mounted on said frame means on the lower outboard side thereof from said lifting deck.

7. Apparatus of claim 6 further comprising a wearable pad secured to said face plate for contacting the end of said roll.

8. Apparatus of claim 7 further comprising a wearable pad secured to said frame means adjacent said guide means and facing said lifting deck.

9. Apparatus of claim 1 further comprising first roller means mounted on said frame means in proximity to and below said lifting deck.

10. Apparatus of claim 1 further comprising second roller means mounted on said frame means on the lower outboard side thereof from said lifting deck.

11. Apparatus of claim 10 further comprising first roller means mounted on said frame means in proximity to and below said lifting deck.

12. Apparatus of claim 11 further comprising means for controlling the horizontal and vertical movement of said guide means relative to said frame means.

13. Apparatus of claim 12 in which said guide means further comprises:

a. a slide member having a vertical face plate and parallel side plates, said side plates being provided with upper and lower vertical slots;

b. a pair of upper arms each pivotally mounted amid its length to said frame means and having means at one end thereof for engaging one of said upper vertical slots;

c. a pair of lower arms each pivotally mounted amid its length to said frame means and having means at one end thereof for engaging one of said lower vertical slots;

d. link means joining the other ends of said upper and said lower arms; and, e. dampening means pivotally mounted on said frame means and coupled to said link means.

14. Apparatus of claim 13 further comprising means mounted on said frame means for returning said guide means from its displaced position to its rest position.

15. Apparatus for grasping a roll of material having a horizontal eye, comprising:

a. a pair of horizontally displaceable, opposing lifting legs, each leg comprising:

(1) a frame means;

(2) guide means supported by said frame means for yieldingly contacting the end of said roll and for horizontal and vertical movement relative to said frame means from a rest position to a displaced position;

(3) a horizontal lifting deck affixed to said frame means for engaging said horizontal eye;

b. a frame for movably supporting said pair of legs; and, c. means for moving said legs horizontally relatively so as to enable said lifting decks to engage said eye.

16. Apparatus of claim 15 further comprising means for controlling the horizontal and vertical movement of each of said guide means relative to the respective said frame means.

17. Apparatus of claim 16 in which each said guide means further comprises:

a. a slide member having a vertical face plate and parallel side plates, said side plates being provided with upper and lower vertical slots;

b. a pair of upper arms each pivotally mounted amid its length to the respective said frame means and having means at one end thereof for engaging one of said upper vertical slots;

c. a pair of lower arms each pivotally mounted amid its length to the respective said frame means and having means at one end thereof for engaging one of said lower vertical slots;

d. link means joining the other ends of said upper and said lower arms; and, e. dampening means pivotally mounted on the respective said frame means and coupled to said link means.

18. Apparatus of claim 17 further comprising means mounted on each said frame means for returning the respective said guide means from its displaced position to its rest position.

19. Apparatus of claim 18 further comprising:

a. first roller means mounted on each said frame means in proximity to and below the respective lifting deck; and, b. second roller means mounted on each said frame means on the lower outboard side thereof from the respective said lifting deck.

20. Apparatus of claim 15 further comprising:

a. first roller means mounted on each said frame means in proximity to and below the respective said lifting deck; and, b. second roller means mounted on each said frame means on the lower outboard side thereof from the respective said lifting deck.

21. Apparatus of claim 20 in which each said guide means further comprises:

a. a slide member having a vertical face plate and parallel side plates, said side plates being provided with upper and lower vertical slots;

b. a pair of upper arms each pivotally mounted amid its length to the respective said frame means and having means at one end thereof for engaging one of said upper vertical slots;

c. a pair of lower arms each pivotally mounted amid its length to the respective said frame means and having means at one end thereof for engaging one of said lower vertical slots;

d. link means joining the other ends of said upper and said lower arms; and, e. dampening means pivotally mounted on the respective said frame means and coupled to said link means.

22. Apparatus of claim 21 further comprising means for controlling the horizontal and vertical movement of each said guide means relative to the respective said frame means.

23. Apparatus of claim 22 further comprising means mounted on each said frame means for returning the respective said guide means from its displaced position to its rest position.

* * * * *